US005446233A

United States Patent [19]

Lewis et al.

[11] Patent Number: 5,446,233

[45] Date of Patent: Aug. 29, 1995

[54] ETHYLENE PLANT CAUSTIC SYSTEM EMULSION BREAKING WITH SALTS OF ALKYL SULFONIC ACIDS

[75] Inventors: Vincent E. Lewis, Missouri City; Sherri L. Fisher, Sugar Land, both of Tex.

[73] Assignee: Nalco Chemical Company, Naperville, Ill.

[21] Appl. No.: 225,505

[22] Filed: Apr. 11, 1994

Related U.S. Application Data

[63] Continuation of Ser. No. 124,664, Sep. 21, 1993, abandoned.

[51] Int. Cl.[6] ..... G07C 7/17; C10G 67/08; B01D 17/00

[52] U.S. Cl. ..... 585/856; 585/866; 208/98; 252/358; 252/331

[58] Field of Search ..... 585/856, 866; 208/98; 252/358, 331

[56] References Cited

U.S. PATENT DOCUMENTS 4,041,102 8/1977 Wronka ..... 260/683.62
4,100,966 7/1978 Bonsaid ..... 166/273
4,440,625 4/1984 Go et al. ..... 208/48 A A
4,681,165 7/1987 Bannister ..... 166/312
4,737,265 4/1988 Merchant et al. ..... 208/188

FOREIGN PATENT DOCUMENTS

1456415A1 2/1989 U.S.S.R. .

OTHER PUBLICATIONS

Har, et al. *Hydrocarbons in Ionic Microemulsion.* Institute of National Science, pp. 17, 84 (1979).
Nalco Bulletin regarding Nalco 5512 Emulsion Breaker, pp. 1–2 (year unavailable).

*Primary Examiner*—Anthony McFarlane
*Assistant Examiner*—Nhat D. Phan
*Attorney, Agent, or Firm*—Robert A. Miller; James J. Drake

[57] ABSTRACT

A process for breaking the emulsion which commonly forms in the caustic system of olefin plants comprising mixing the emulsion with an effective amount of a Group II metal salt of an alkyl aryl sulfonic acid, wherein the alkyl contains 4–24 carbon atoms, most preferably 8–14 carbon atoms.

10 Claims, No Drawings

ETHYLENE PLANT CAUSTIC SYSTEM EMULSION BREAKING WITH SALTS OF ALKYL SULFONIC ACIDS

This application is a continuation of application Ser. No. 08/124,644, filed Sep. 21, 1993, entitled "ETHYLENE PLANT CAUSTIC SYSTEM EMULSION BREAKING WITH SALTS OF ALKYL ARYL SULFONIC ACIDS", now abandoned.

FIELD OF THE INVENTION

This invention relates to a method for breaking up emulsions which typically form in the caustic systems of cracking operations designed to produce olefins. More particularly, the invention concerns a method for breaking up caustic emulsions of oxygenated compounds which form in the caustic systems of olefin plants.

BACKGROUND OF THE INVENTION

In cracking operations, such as in the pyrolytic cracking of ethane, propane, and naphtha to form olefins, oxygenated compounds including carbonyl compounds such as aldehydes and ketones are formed. The amount of carbonyl compounds formed in such operations can vary widely, but is typically about 1–100 ppm in the product gas stream. Concentrations as high as 1000 ppm are occasionally encountered depending upon the use of various feedstocks and cracking temperatures. The product gas stream is typically passed through a basic wash (pH>7) to remove acidic components such as hydrogen sulfide and carbon dioxide. Oxygen containing compounds, particularly acetaldehyde, tend to undergo polymerization in the presence of the basic wash or scrubbing conditions.

In the caustic scrubbing system of such plants, the polymers of acetaldehyde and other oxygenated compounds are able to mix with the caustic, which may form an emulsion. In some plants this emulsion can become severe enough to be a bottleneck to plant operations. In other plants, the polymers are removed quite easily from the caustic scrubbing system along with the spent caustic. The spent caustic and polymers are then pumped to an accumulator or surge drum.

In the surge drum, hydrocarbon and aqueous layers are separated. The hydrocarbons are lighter than water and float to the top of the drum, where they are skimmed off and disposed of. Caustic which has separated from the hydrocarbon is then treated in various ways and returned to the caustic scrubbing system. Unfortunately, the acetaldehyde polymer and other organic polymers occasionally form stable emulsions in the surge drum, and these emulsions seriously interfere with the separation of caustic and hydrocarbons in the surge drum. The hydrocarbons then contain too much caustic to be disposed of, and less caustic is available to be restored to the system. At the present time there exists a continuing need for an effective demulsifier to break the troublesome emulsions into two distinct layers.

SUMMARY OF INVENTION

The present invention in a broad aspect comprises a method for resolving the emulsions which form in the caustic systems of olefin cracking operations. The invention more particularly comprises the addition of a Group II metal salt of an alkyl aryl sulfonic acid to such a system in a quantity and for a time sufficient to resolve such an emulsion. The invention especially contemplates the addition of Group II metal salts of alkyl benzene sulfonic acids wherein the alkyl group contains between about 4 and 24 carbon atoms, preferably between about 8 and 14 carbon atoms. The calcium salt of dodecylbenzene sulfonic acid is especially preferred. The sulfonate additives of the present invention tend to remain in the caustic phase after an emulsion has been resolved, and are then recirculated with the caustic back to the caustic system.

DETAILED DESCRIPTION OF THE INVENTION

The present invention provides a useful demulsifier for resolving the emulsions which commonly form in the caustic system of olefin plains. Several well-known emulsion breaking chemicals have been found to be ineffective for resolving this troublesome emulsion, including dodecylbenzene sulfonic acid, polyamines, and zinc chloride with polyamines.

Group II metal salts of alkyl aryl sulfonic acids, wherein the alkyl group contains 4 to 24 carbon atoms with 8 to 14 carbon atoms being preferred, have been found to be particularly useful in resolving the emulsions which form in the surge drum of olefin plant caustic systems. The preferred cation of this invention is calcium, and calcium dodecylbenzene sulfonate has been found to effectively break the emulsion which may develop in the caustic accumulator or surge drum of an ethylene plant.

The demulsifier is most effective as an additive directly to the surge drum. As stated above, the surge drum is designed to separate the hydrocarbons and caustics. The demulsifier should be pumped directly into the surge drum by continuous feed. The optimum field rate for the demulsifier will vary based upon the quantity and makeup of the emulsion forming in the surge drum. Those of skill in the an will recognize the type of experimentation necessary to determine the best flow rate for specific plant conditions.

In lab testing, the demulsifier was mixed with an emulsion formed in an ethylene plant until a clear red oil layer appeared on top, and a yellowish caustic water solution comprised the bottom layer. The best performance has been observed at demulsifier dosages of 1000 ppm. However, dosages as small as 100 ppm have also been effective. An initial dosage should be in the range of 100–1000 ppm, with adjustments made as dictated by field conditions.

While changes in the components of this invention may be made by those of skill in this art, such changes are included within the scope of the present invention, which is defined by the following claims.

What is claimed is:

1. A process for breaking the emulsion formed in the caustic system of a hydrocarbon cracking plant comprising mixing the emulsion with an effective amount of a Group II metal salt of a $C_{4-24}$ alkyl aryl sulfonic acid, for a time sufficient to break the emulsion.

2. The process of claim 1 wherein said alkyl is a $C_{8-14}$ alkyl.

3. The process of claim 1 wherein the Group II metal is calcium.

4. The process of claim 1 wherein said salt comprises calcium dodecylbenzene sulfonate.

5. A process for breaking the emulsion formed in the accumulator or surge drum of an ethylene plant caustic system comprising mixing the emulsion with an effective amount of a Group II metal salt of a $C_{4-24}$ alkyl aryl sulfonic acid, for a time sufficient to break the emulsion.

6. The process of claim 5 wherein said alkyl is a $C_{8-14}$ alkyl.

7. The process of claim 5 wherein the Group II metal is calcium.

8. The process of claim 5 wherein said salt comprises calcium dodecylbenzene sulfonate.

9. The process of claim 5 wherein the Group II metal salt of a $C_{4-24}$ alkyl aryl sulfonic acid is added in a dosage of 100–1000 ppm.

10. The process of claim 8 wherein the calcium dodecylbenzene sulfonate is added in a dosage of 100–1000 ppm.

* * * * *